US006684797B2

(12) United States Patent
Nöltge et al.

(10) Patent No.: US 6,684,797 B2
(45) Date of Patent: Feb. 3, 2004

(54) CNC CONTROLLED BUTTONHOLE SEWING MACHINE

(75) Inventors: Thomas Nöltge, Bielefeld (DE); Jochen Fischer, Detmold (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/410,466

(22) Filed: Apr. 9, 2003

(65) Prior Publication Data

US 2003/0192462 A1 Oct. 16, 2003

(30) Foreign Application Priority Data

Apr. 16, 2002 (DE) ..... 102 16 809

(51) Int. Cl.[7] ..... D05B 3/08; D05B 21/00

(52) U.S. Cl. ..... 112/66; 112/73; 112/447

(58) Field of Search ..... 112/66, 70, 65, 112/68, 73, 447, 475.25

(56) References Cited

U.S. PATENT DOCUMENTS 4,312,283 A 1/1982 Fischer et al.
5,778,807 A * 7/1998 Nishizawa ..... 112/70
6,095,066 A * 8/2000 Noltge ..... 112/73 X

FOREIGN PATENT DOCUMENTS

DE 457 750 3/1928
DE 29 38 064 12/1983

OTHER PUBLICATIONS

JUKI Corporation, 2000–2001, JUKI MEB–3200, Instruction Manual Leaflet No. 02 29343316, No.

* cited by examiner

*Primary Examiner*—Peter Nerbun
(74) *Attorney, Agent, or Firm*—McGlew and Tuttle, P.C.

(57) ABSTRACT

A buttonhole sewing machine comprises work piece clamps with a pneumatically actuated displacement drive for displacement relative to each other of the work piece clamps from an initial position of spread by a length of spread into a final position of spread. Only the first work piece clamp is displaceable relative to the x-y table. The displacement of the first work piece clamp is defined between two stop positions. A control unit stores data for triggering an x drive for reversed displacement of the x-y table by half the given length of spread.

5 Claims, 5 Drawing Sheets

CNC CONTROLLED BUTTONHOLE SEWING MACHINE

BACKGROUND OF THE INVENTION

1. Field of the Invention

The invention relates to a CNC controlled buttonhole sewing machine, comprising a needle drivable via an arm shaft; an x-y table, which is displaceable placeable in an x direction by an x drive and in a y direction by a y drive, and which supports a first and a second work piece clamp mounted for displacement relative to each other, and which comprises a pneumatically actuated displacement drive for displacement of the work piece clamps relative to each other from an initial position of spread by a length of spread into a final position of spread; and a control unit for control of the drives.

2. Background Art

The JUKI MEB-3200 Instruction Manual leaflet no. 02 29343316 describes a CNC controlled buttonhole sewing machine of the generic type. It comprises an x-y table which is displaceable on the sewing plane by two stepper motors as x and y drives. Two work piece clamps are disposed on the x-y table, holding a work piece thereon. By means of a pneumatic cylinder, they are displaceable in the x direction on the sewing plane, which is formed by the x-y plane, in mirror symmetry to a center plane. Both pneumatic cylinders are operable by means of a control command that is stored in the control unit. Provided on each side of the x-y table are setscrews, enabling the length of spread of each work piece clamp to be set from a non-modifiable inner initial position of spread to a final position of spread.

Shifting the work piece clamps enables the tightly clamped work piece to be stretched and spread into a tautened plain position. It is possible in this way to produce high quality buttonholes. Spreading the work piece also creates sufficient room for the needle, in case the buttonhole is first cut and then sewn i.e., with the sewing machine working in a so-called preconditioning mode. The displacement of each work piece clamp is in the range of 1.0 mm so that the clamps can be moved apart by a length of spread of 2.0 mm. The length of spread depends on various sewing parameters such as the structure of the work piece i.e., material, thickness and the like, the kind of threads used for sewing, thread tightening, needle size, possible use of a gimp thread and further parameters.

Drawbacks of the known sewing machine reside in that the initial position of spread and the length of spread i.e., the final position of spread, are attainable only by complicated adjustment jobs with the aid of implements such as a screw driver and measuring instrument. These jobs need a learned mechanic. The numerous components needed for adjusting are susceptible to wear. It is difficult to retrieve the adjustments that have been determined empirically and make them reproducible. Each buttonhole seam of varying width needs renewed adjustment; otherwise it is not possible to clamp the work piece in vicinity to the buttonhole seam that is to be sewn.

German patent 457 750 teaches a spreading device for the work piece clamp of buttonhole sewing machines; it has work piece clamps which are relocatable in symmetry to a center plane by means of a mechanism. Provision is made for a lever mechanism with a manually adjustable stop, by adjustment of which the length of spread is modifiable. This known device also includes the mentioned drawbacks.

U.S. Pat. No. 4,312,283 describes an automatic sewing machine, in which a CNC control unit produces coordinate data for motion of a sewing machine relative to an adjustable-size work piece holder. So as to avoid any collision of the needle with the work piece holder, information on the current setting of the work piece holder is fed to the control unit for it to automatically correct a sewing program.

SUMMARY OF THE INVENTION

It is an object of the invention to develop a buttonhole sewing machine of the generic type such that adjustment of the length of spread by an operator is easily feasible by simple means.

According to the invention, this object is attained by the features in which only the first work piece clamp is displaceable relative to the x-y table, and the second work piece clamp is non-displaceable relative to the x-y table; and means are provided for defining the displacement of the first work piece clamp relative to the x-y table by a given length of spread between a first stop position and a second stop position of the first work piece clamp; and the control unit stores data for triggering the x drive for reversed displacement of the x-y table by half the given length of spread. The solution according to the invention ensures that the length of spread can be preset very conveniently. Only one work piece clamp is movable in relation to the x-y table, compensating motions being produced by the possibility of displacement of the x-y table. This simple solution is possible although only the movable work piece clamp is designed for displacement by means of a pneumatically actuated displacement drive.

Details of the invention will become apparent from the ensuing description of three exemplary embodiments, taken in conjunction with the drawing.

DESCRIPTION OF THE PREFERRED EMBODIMENTS

Figure 1:
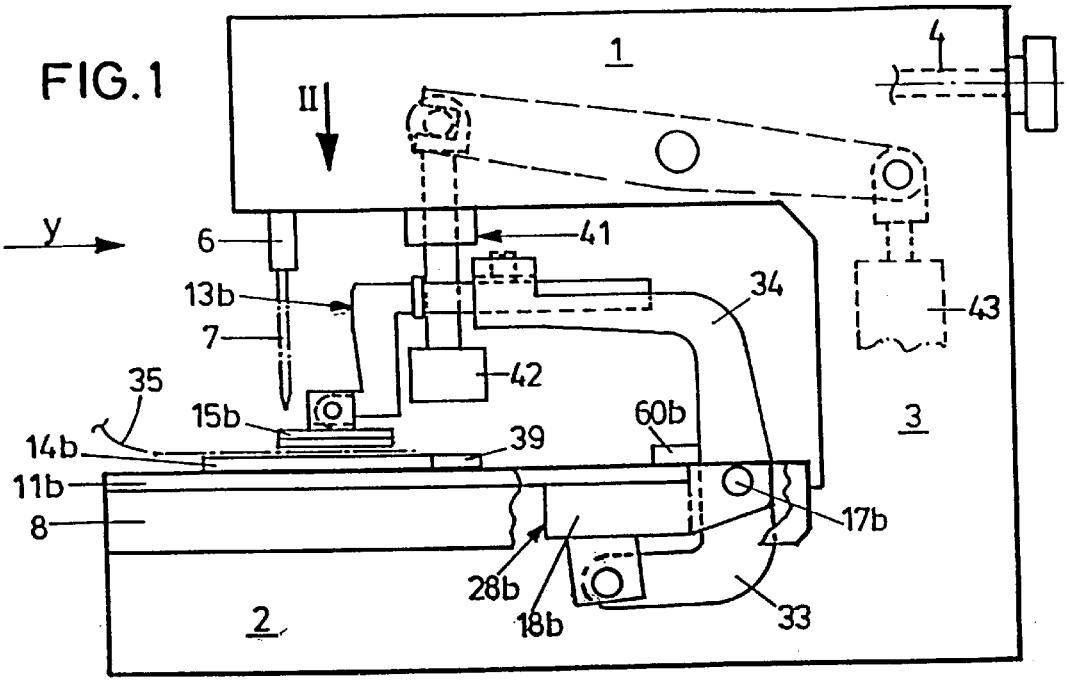
FIG. 1 is a side view of a buttonhole sewing machine.
Figure 2:
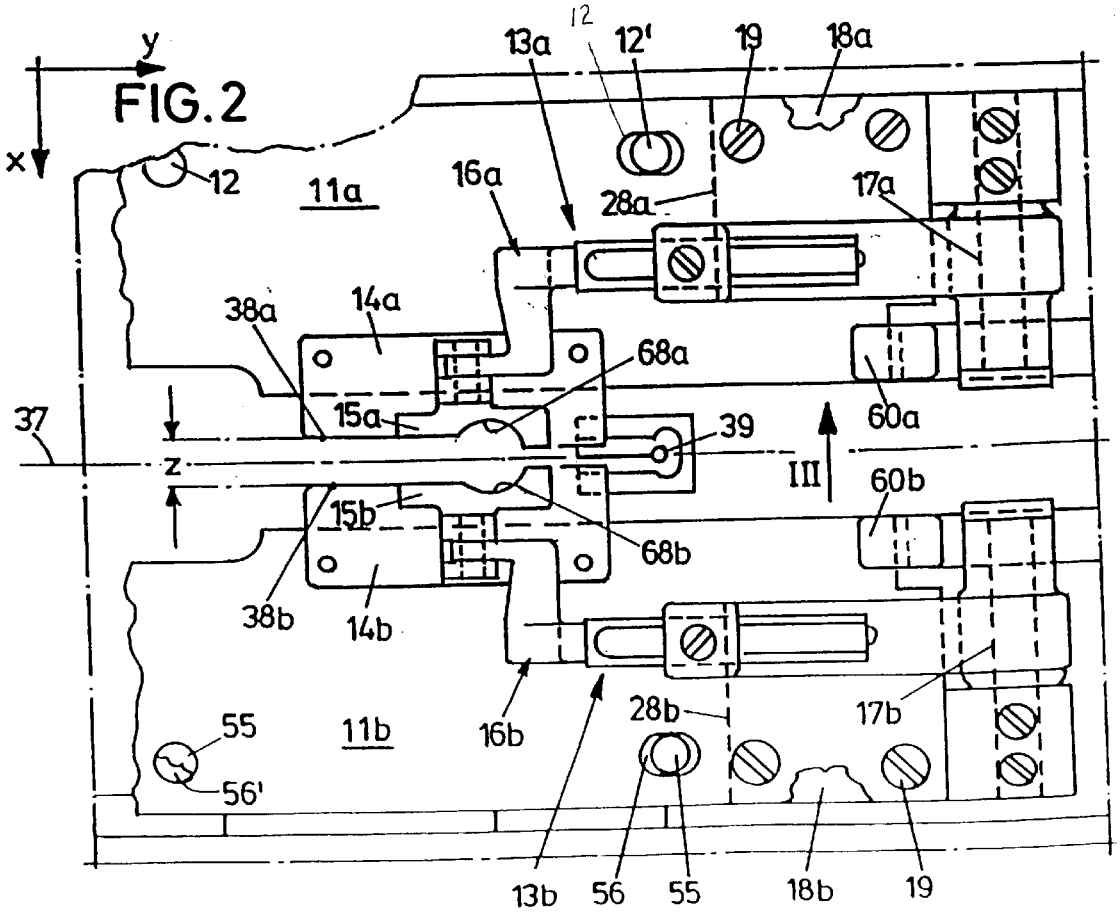
FIG. 2 is a partial plan view of an x-y table of the sewing machine in accordance with the arrow II of FIG. 1.
Figure 3:
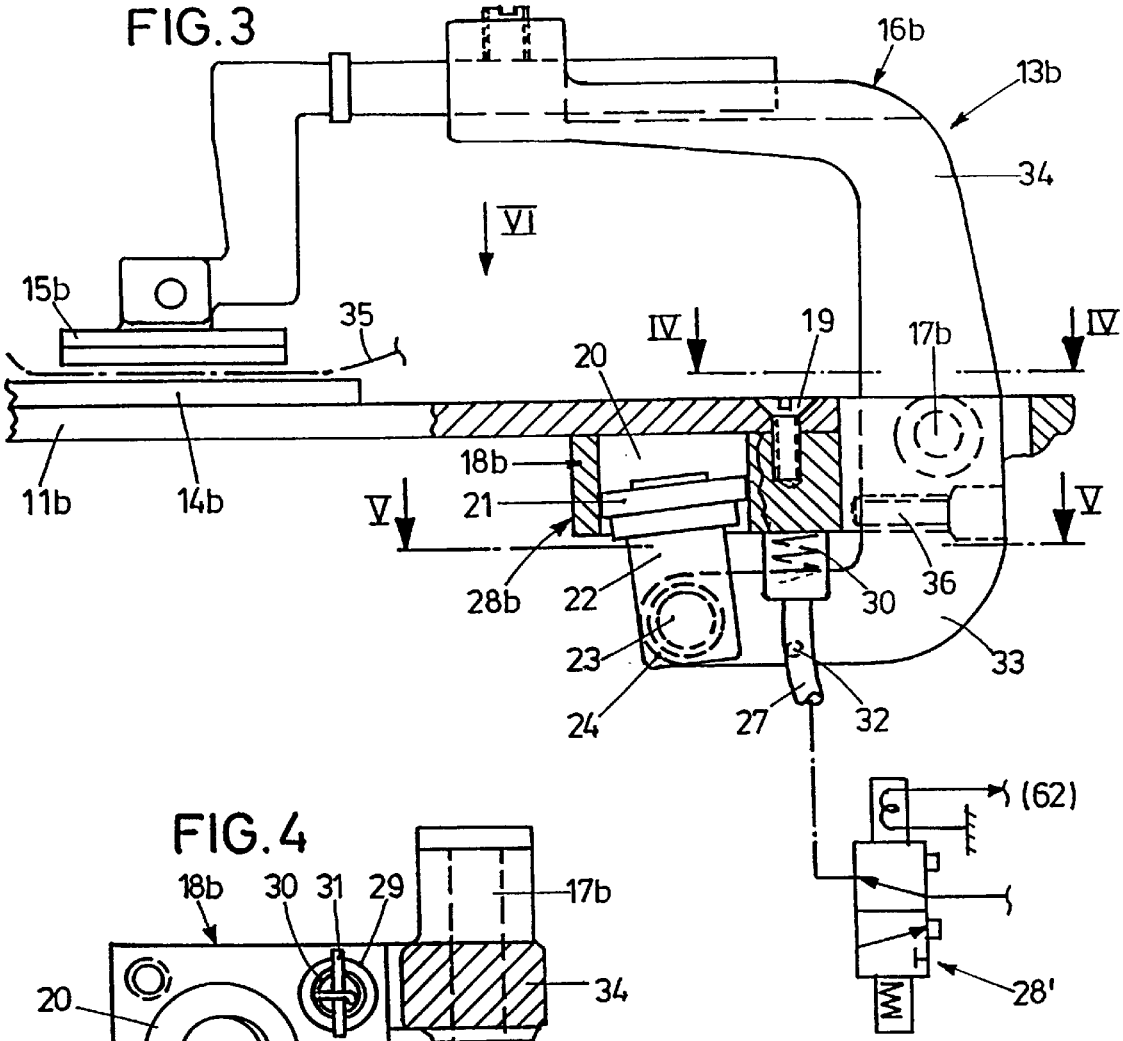
FIG. 3 is a partial side view of the sewing machine on an enlarged scale.
Figure 4:
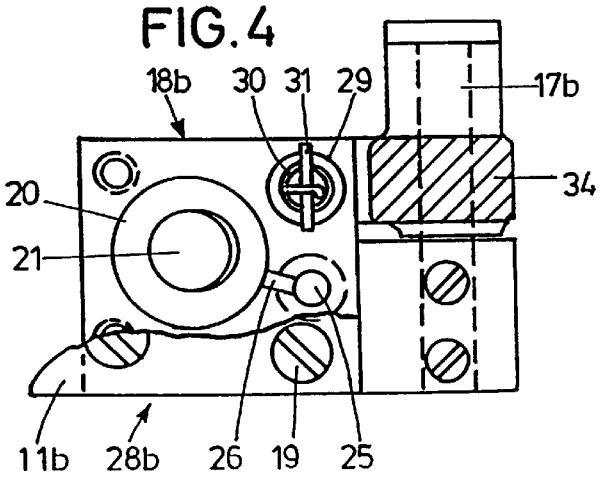
FIG. 4 is a view on the line IV—IV of FIG. 3.
Figure 5:
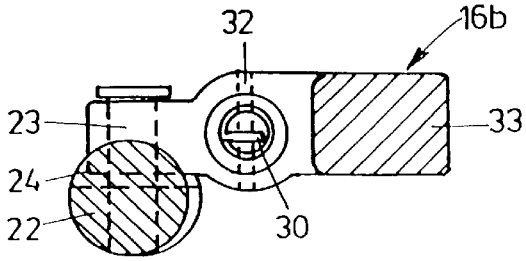
FIG. 5 is a partial cross-sectional view of the sewing machine on the line V—V of FIG. 3.
Figure 8:
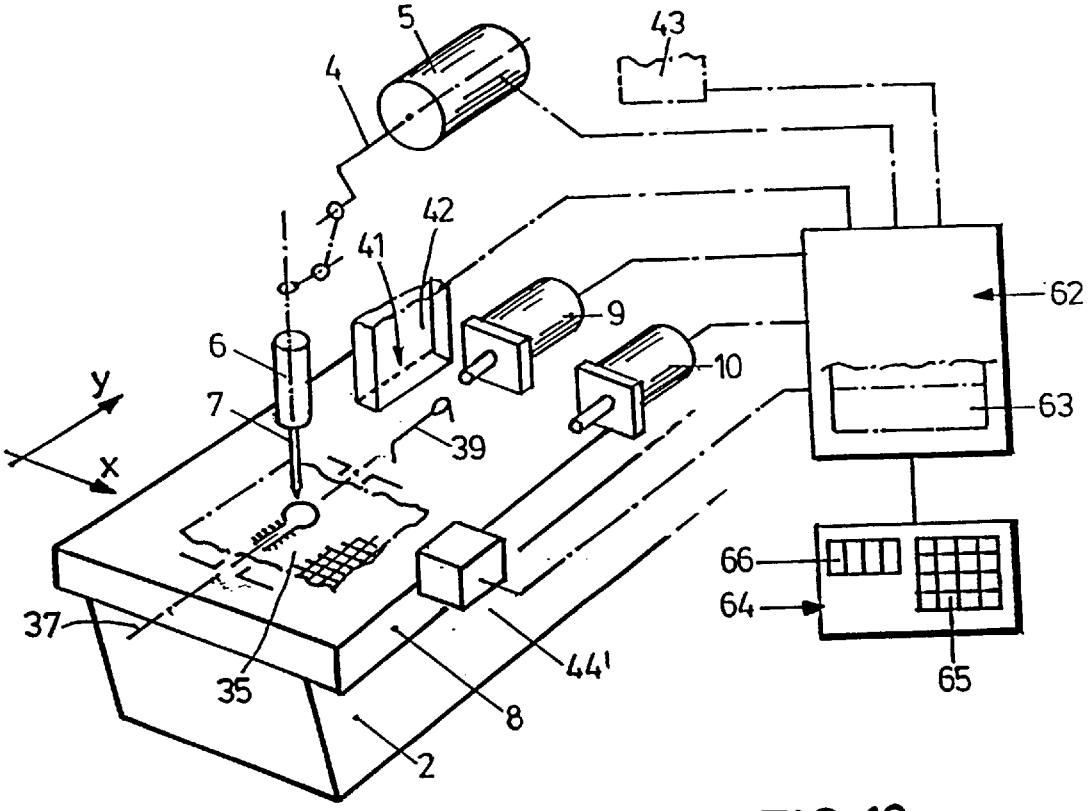
FIG. 8 is a perspective view of part of the buttonhole sewing machine inclusive of the linkage in circuit of the various drives to the control unit and the operating unit.

As seen in FIG. 1, a buttonhole sewing machine is C shaped, having a top arm 1, a bottom base plate 2 in the form of a casing and an approximately vertical standard 3 that unites the two. An arm shaft 4 is conventionally lodged in the arm 1; it is drivable by a motor 5 which is only roughly outlined in FIG. 8. The actuation of a vertically displaceable needle bar 6 with a needle 7 and a jogging drive therefor customarily derive from the arm shaft 4.

Disposed on the base plate 2 is an x-y table 8 which is a cross slide that is movable in two horizontal coordinate directions, namely the x and the y direction. The x-y table 8 is of conventional design as known for example from U.S. Pat. No. 6,095,066. Actuation of the x-y table 8 takes place by drives roughly outlined only in FIG. 8, namely an x drive 9 and a y drive 10, which are electric positioning motors, preferably stepper motors, or controllable D.C. motors.

A two-piece supporting plate 11*a*, 11*b* is disposed on the x-y table 8. The sectional supporting plate 11*a* on the left—seen in the y direction—is fixed to the x-y table 8 by positioning devices 12, 12'. The positioning devices 12, 12' are formed by recesses in the sectional supporting plate 11*a* and by pins which are tightly mounted on the x-y table 8. The sectional supporting plate 11*a* is non-displaceable in relation to the x-y table 8. The sectional supporting plate 11*b* on the right—seen in the y direction—is supported for displacement in the x direction on the x-y table 8. The top surfaces of the sectional supporting plates 11*a*, 11*b* are on a joint x-y plane.

Mounted on each sectional supporting plate 11*a* and 11*b* is a work piece clamp 13*a* and 13*b*, comprising a sectional bearing plate 14*a* and 14*b* which is mounted on the respective sectional supporting plate 11*a* and 11*b* and to each of which is allocated a clamping plate 15*a* and 15*b*. The clamping plates 15*a*, 15*b* are mounted on double-armed bearing levers 16*a*, 16*b*.

Each double-armed bearing lever 16*a*, 16*b* is lodged in a drive and bearing housing 18*a*, 18*b* by means of a pivot bearing 17*a*, 17*b*. The housing 18*a*, 18*b* is tightly fixed to the underside of the supporting plate 11*b* by screws 19, the contact areas of both components being tightly fitted to each other in a manner impervious to compressed air by a liquid sealant (not shown). The work piece clamp 13*b* will be described in detail below.

The housing 18*b* includes a continuous cylindrical chamber 20, which is open downwards and closed upwards by the supporting plate 11*b*, with a piston 21 disposed therein for sealed upward and downward reciprocating motion. This piston 21 has a piston rod 22 which stands out downwards from the cylindrical chamber 20 and is articulated by a hinge 23 to the corresponding end 24 of the bearing lever 16*b*. A compressed-air duct 25 is formed in the housing 18*b* by the side of the cylindrical chamber 20 and, on the upper side of the housing 18*b*, is connected to the cylindrical chamber 20 by an overflow duct 26. On the lower side of the housing 18*b*, a compressed-air line 27 opens into the compressed-air duct 25; the compressed-air line 27 is connected to an electromechanically operated 3/2-port directional control valve 28', a so-called solenoid valve. The described unit in the form of a unilaterally pneumatically actuated piston-cylinder unit constitutes a clamping drive 28*b*.

In the housing 18*b*, a hole 29 is provided by the side of the compressed-air duct 25 with a pre-loaded extension spring 30 disposed therein, which is fixed in place by a detaining pin 31 on the upper side of the housing 18*b* and by another detaining pin 32 on the bearing lever 16. By means of the pre-loaded extension spring 30, the bottom lever portion 33, between the pivot bearing 17*b* and the hinge 23, is pulled upwards towards the clamping drive 28*b* so that the top lever portion 34 of the bearing lever 16*b* is pivoted upwards i.e., the clamping plate 15*b* is lifted off the supporting plate 11*b*. If, however, compressed air flows into the chamber 20 above the piston 21 via the compressed-air line 27, the compressed-air duct 25 and the overflow duct 26, the piston 21, together with the bottom lever portion 33, is displaced downwards against the force of the extension spring 30 so that the top lever portion 34 and the clamping plate 15*b* are pivoted towards the supporting plate 11*b*, thereby possibly clamping a work piece 35.

A setscrew 36 is disposed in the bottom lever portion 33, bearing against the housing 18*b* and serving for adjustment of the length by which the clamping plate 15*b* is lifted off the bearing plate 14*b*.

Arranging the clamping drive 28*b* between the bearing lever 16*b* and the supporting plate 11*b* ensures that the forces that act within the work piece clamp 13*b* are kept within the clamp 13*b* and do not act on the x-y table 8. The other supporting plate 11*a* and the work piece clamp 13*a* are embodied in like manner.

In a zero position, the sectional supporting plates 11*a*, 11*b* are symmetrical to a center plane 37 so that opposite edges 38*a*, 38*b* of the bearing plates 14*a*, 14*b* have a distance z of for instance 6 millimeters between them. In this plane 37, a stationary knife 39 for buttonhole-40 cutting is arranged on the base plate 2 of the sewing machine. This knife 39 is part of a cutting device 41 which also includes an anvil 42 which is movable by a cutting drive 43, reciprocating up and down on the bottom side of the arm 1.

Figure 6:
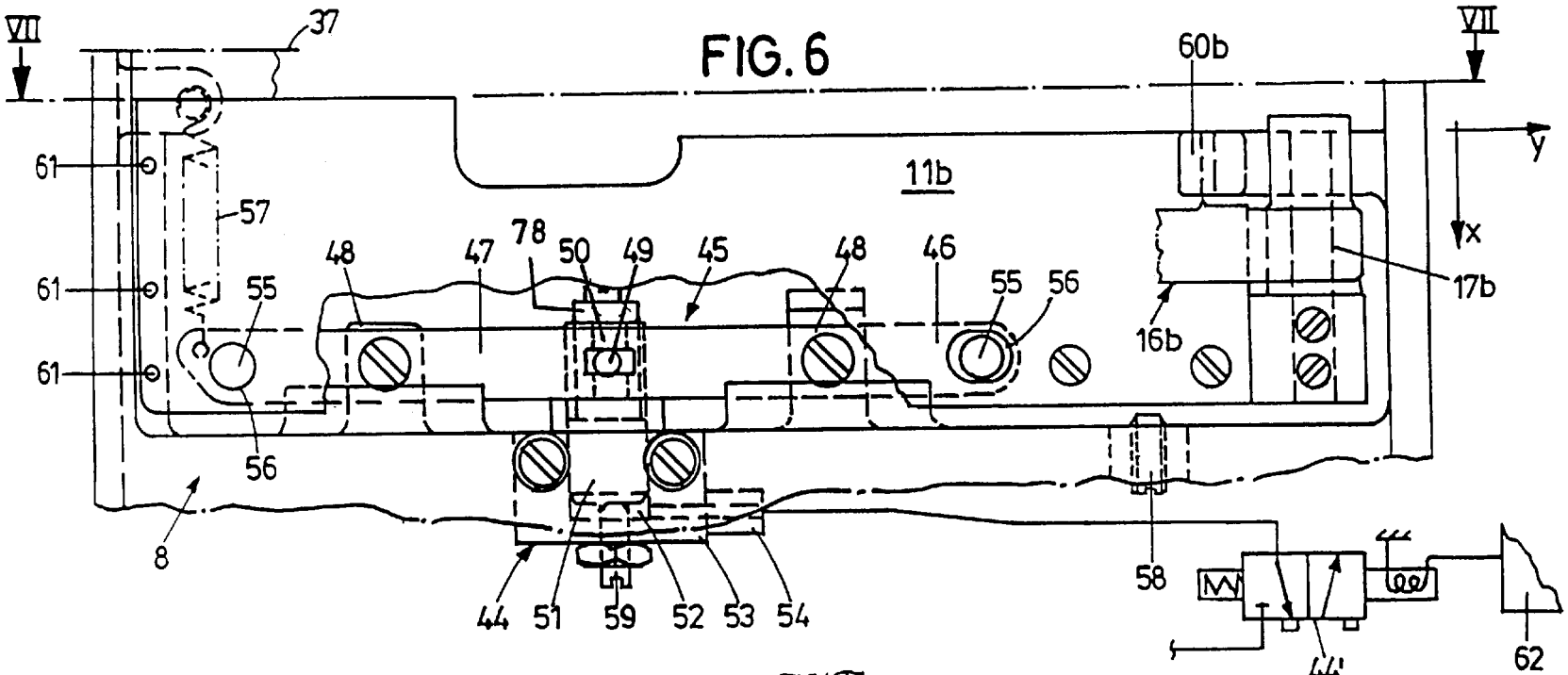
FIG. 6 is a partial plan view of the sewing machine in accordance with the arrow VI of FIG. 3.
Figure 7:
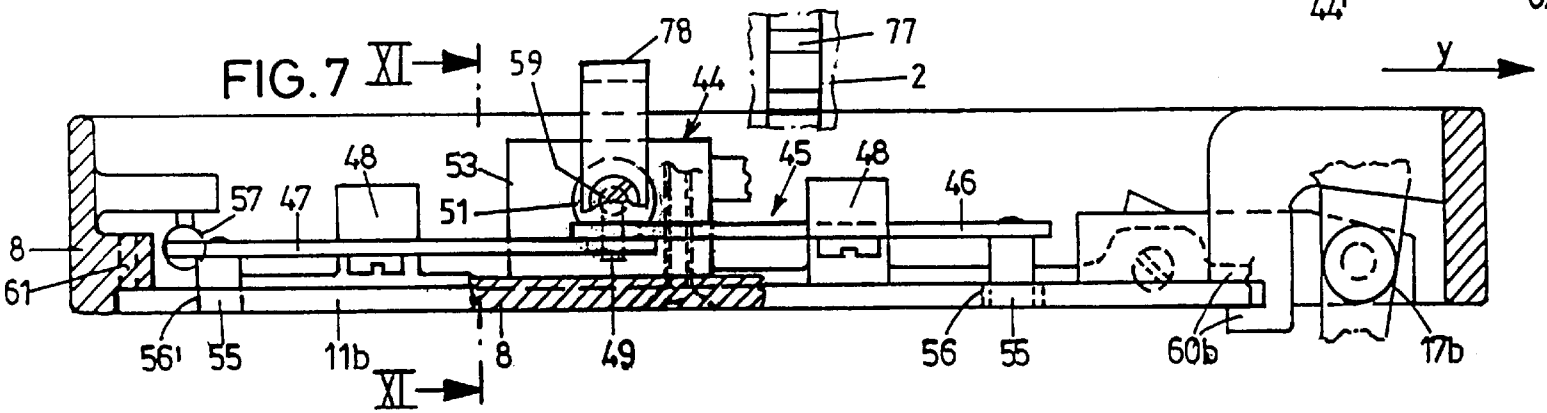
FIG. 7 is a vertical section of the sewing machine on the line VII—VII of FIG. 6.

A design of a displacement drive for the sectional supporting plate 11*b* will become apparent from FIGS. 6, 7. The sectional supporting plate 11*b* is guided for displacement directly on the x-y table 8. A pneumatically actuated displacement drive 44 is fixed to the x-y table 8 underneath the supporting plate 11*b*. It is coupled with a lever arrangement 45 which confers the shifting motions to the sectional supporting plate 11*b*. To this end, a first lever 46 and a second lever 47, which are both double-armed levers, are pivotably housed by their central portion in bearings 48 which are formed on the x-y table 8. The levers 46, 47 overlap one another at their ends turned towards each other; these ends have U-shaped recesses that run in the lengthwise direction of the levers 46, 47 (FIG. 6). This is where a bolt 49 passes through; the bolt 49 is provided on the drive 44 which is perpendicular to the principal direction of the levers 46, 47. The bolt 49 is mounted on a piston rod 50 of the drive 44, the piston rod 50 being joined to the piston 51 of the drive 44. The piston 51 is displaceably disposed in the interior space 52 of the casing 53 of the drive 44. A compressed-air supply line 54 with an electromechanically actuated 3/2-port direction control valve 44' located therein opens into the space 52.

The ends of the levers 46, 47 that face away from each other are provided with a pin 55, one pin 55 reaching into an oblong hole 56 and the other pin 55 into a circular hole 56' in the sectional supporting plate 11*b*. A pre-loaded extension spring 57, which is connected with the x-y table 8, acts on the end, neighboring the pin 55, of the second lever 47.

When the displacement drive 44 is actuated by compressed air, then the bolt 49 and the two ends, coupled therewith, of the levers 46, 47 are displaced counter to the x direction, as a result of which the sectional supporting plate 11*b* is shifted in the x direction against the pre-load of the extension spring 57. Upon pressure relief of the displacement drive 44, the sectional supporting plate 11*b* is restored by the extension spring 57 counter to the x direction.

Attached to the x-y table 8 is a first setscrew 58 as an adjustable stop, by means of which to define and set a first stop position of the sectional supporting plate 11*b* in the x direction. A second setscrew 59 is provided as an adjustable stop on the displacement drive 44, defining the restoring path of the piston 51 in the x direction, which again defines a second stop position of the sectional supporting plate 11 counter to the x direction. The two setscrews 58, 59 serve to define the stop positions and thus the length of displacement of the sectional supporting plate 11*b*.

The sectional supporting plate 11*b*, which is made of steel, is secured on the x-y table 8 in the vertical direction by engaging from below with a nose 60*b* on one side while being held by permanent magnets 61 on the side neighboring the extension spring 57. The sectional supporting plate 11*a* is likewise held on the x-y table 8 by a nose 60*a* and corresponding permanent magnets.

The sewing machine is provided with a control unit 62, by way of which are triggered the x drive 9, the y drive 10. the valve 44' for the displacement drive 44, the driving motor 5 of the arm shaft 4, the clamping drives 28*a*, 28*b* and the cutting drive 43. The control unit 62 includes a memory unit 63. An operating unit 64 with a keyboard 65 and a display 66 are allocated to the control unit 62.

Programs and data are stored in the memory unit 63, relating to a buttonhole seam 67 that is going to be produced. Ranges of values are stored for the distance z; they are allocated to the final positions of spread which are to be taken by the sectional supporting plate 11*b*.

Before a sewing job is started, the x-y table 8 is conventionally moved, in accordance with the data stored in the memory unit 63, into the zero position by the drives 9, 10 in the form of stepper motors; in the zero position the center plane 37 also accommodates the needle 7 in its vertical central position. Zero positioning of this type is general practice in sewing control technique and does not require any further explanation. By corresponding actuation of the operating unit 34, the operator selects a certain type of buttonhole 40 with a buttonhole seam 67.

This is followed by an adjustment job made by the operator for the spreading motion. To this end, a certain key of a keyboard 65 is operated in the operating unit 64, by which to move the sectional supporting plate 11*b* alternately into the first or second stop position. It is thus possible to adjust the respectively unloaded setscrew 58 or 59. This job is repeated until the given values of the distance z can be measured at the edges 38*a*, 38*b* of the bearing plates 14*a*, 14*b* by the aid of a slide gauge.

The adjustment job is accompanied with a transfer, by the operator, of given data of spread to the displacement drive 44 which positions the sectional supporting plate 11*b*. In the reverse case it is also possible, in the memory unit 63, to store data of spread i.e., values for the stop positions of the sectional supporting plate 11*b*, that have been determined empirically.

After termination of the adjustment job, a key of the operating unit 64 is actuated and, by the displacement drive 44 being triggered, the sectional supporting plate 11*b* and the work piece clamp 13*b* are moved into an initial position of spread in which the longitudinal edges 38*a*, 38*b*, defining the sectional openings 68*a*, 68*b*, of the clamping plates 15*a*, 15*b* have a distance a, corresponding to the distance z, from each other that corresponds to the total width b of the buttonhole seam 67 plus a distance c of for instance 0.5 mm between the buttonhole seam 67 and each neighboring longitudinal edge 38*a* and 38*b*.

Figure 9:
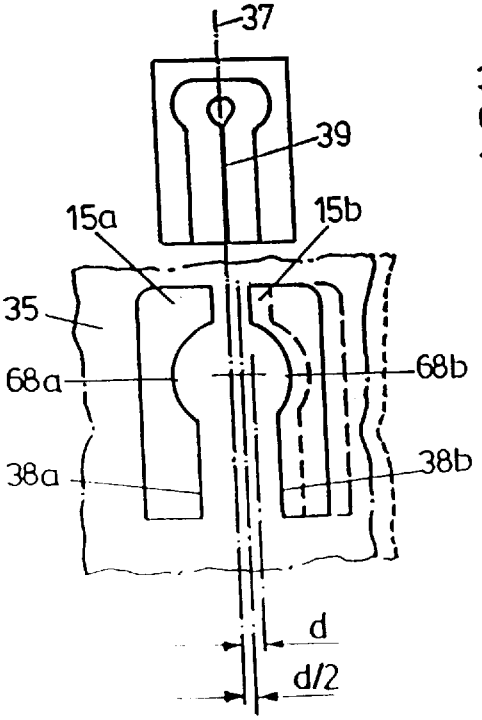
FIG. 9 is a plan view of parts of the sewing machine on an enlarged scale as opposed to FIG. 2.
Figure 10:
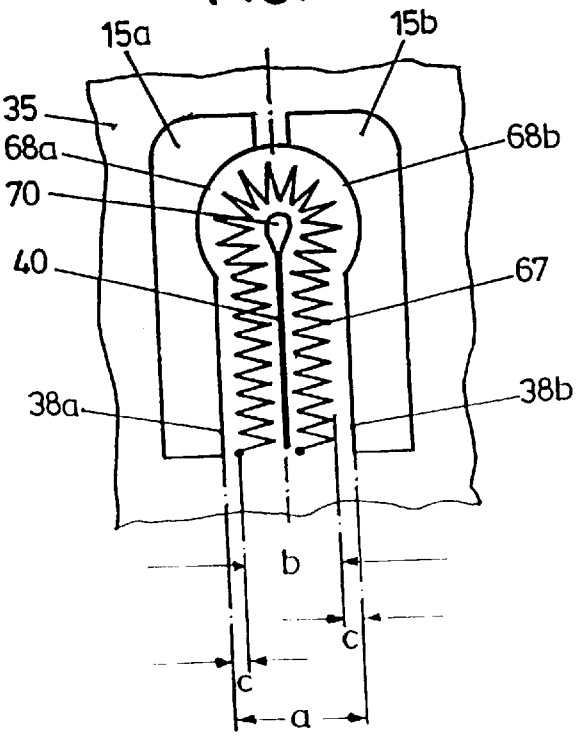
FIG. 10 is a plan view of a work piece with an eyelet buttonhole.

Then the operator releases the work piece clamps 13*a*, 13*b* via the operating unit 64 or automatically in accordance with the stored sewing program; the operator may then place and align the work piece 35 on the bearing plates 14*a*, 14*b*. Subsequently, the work piece clamps 13*a*, 13*b* are closed by corresponding triggering of valves 28' for actuation of the clamping drives 28*a* and 28*b* so that the work piece 35 is clamped by both work piece clamps 13*a*, 13*b*. Afterwards, displacement of the sectional supporting plate 11*b*, together with the work piece clamp 13*b*, in the x direction by the length of spread d that results from the set stop positions takes place fully automatically by means of the displacement drive 44 which is triggered by the control unit 62. Simultaneously or directly afterwards, the x-y table 8 is moved by a length d/2 in the reversed direction so that the two bearing plates 14*a*, 14*b* are in their final position of spread again in mirror symmetry to the center plane 37. As a result, the sectional openings 68*a*, 68*b* are again in mirror symmetry to the center plane 37. The clamped and spread work piece 35 is positioned underneath the needle 6 in a position that is precisely defined for execution of the sewing operation. Solid lines in FIG. 9 illustrate the initial position of the clamping plate 15*b* and dashed lines show the position of spread after displacement of the sectional supporting plate 1 b by the length of spread d but prior to compensation through reversal of the x-y table 8 by half the length of spread d/2. Cutting the buttonhole 40 by means of the knife 39 may take place prior to the buttonhole-40 sewing job or afterwards. As seen in FIG. 10, the buttonhole seam 67 is a conventional flat stitch seam produced by a corresponding needle jogging drive of the needle bar 6. Stay stitches (not shown) may be sewn additionally at the end of the buttonhole seam 67 that is opposite the buttonhole eye 70.

Figure 12:
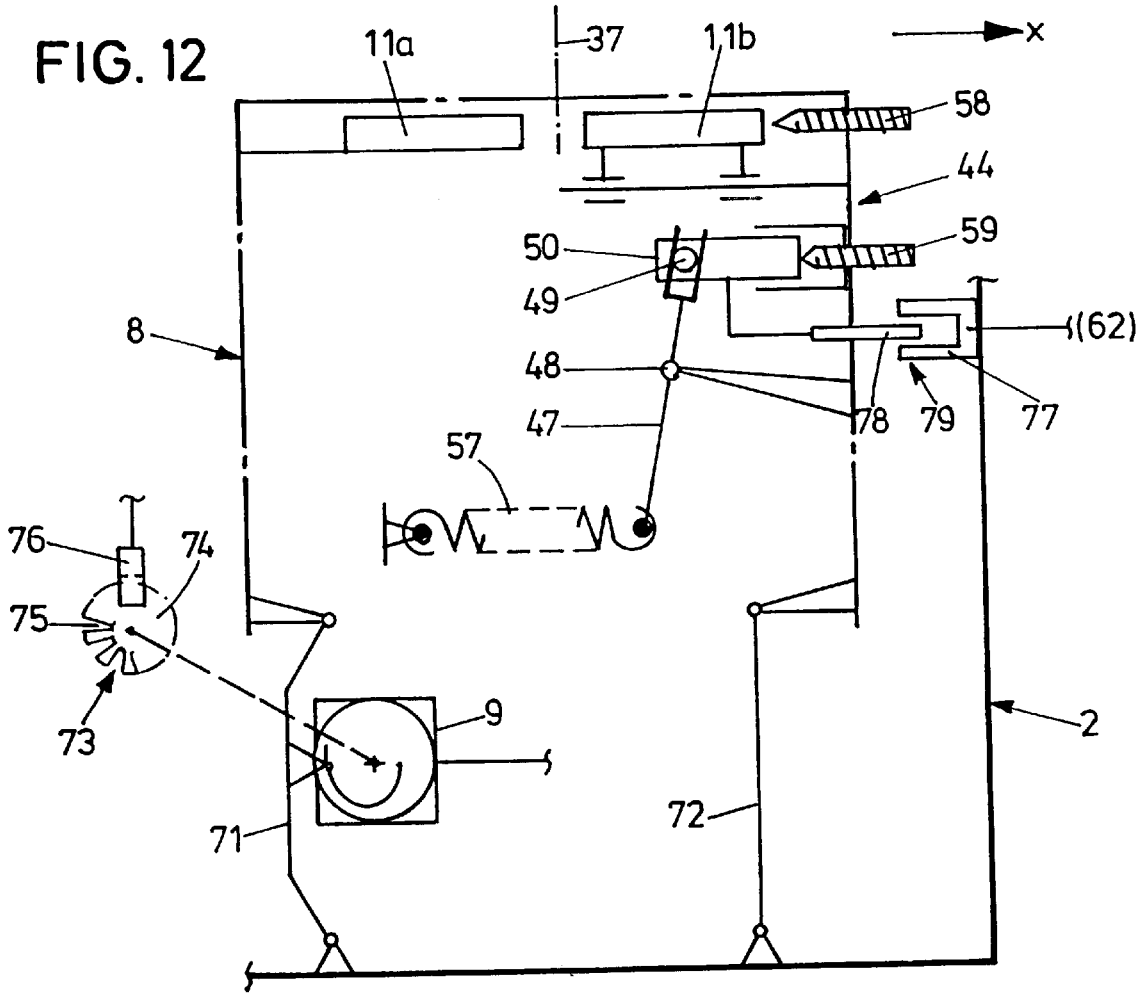
FIG. 12 is a diagrammatic illustration reflecting the principle of function.
Figure 11:
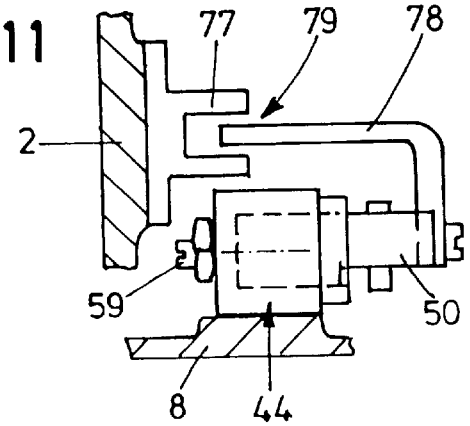
FIG. 11 is a view on the line XI—XI of FIG. 7.

As seen in particular in FIG. 12, the x-y table 8 is supported on the base plate 2 via a system of steering levers 71, 72. The length of the steering levers 71, 72 is comparatively great in relation to the maximal motion of the table 8 of approximately 8 mm in the x direction, there being near rectilinear motion of the x-y table 8 in the x direction.

The x drive 9 can be provided with a known and commercial rotary position transmitter 73, which has a slit disk 74 and a light barrier 76 which scans the slits 75 of the disk 74 and emits a signal to the control unit 62 for each slit 75 that passes by. Using such a rotary position transmitter 73 is suitable in the case of closed-loop control of the x drive 9 by the control unit 62. It can be dropped when the x drive 9 is formed by a stepper motor that works without rotary position feedback.

A forked light barrier 77 is disposed on the base plate 2 i.e., it is stationary; a trigger blade 78, which is mounted on the piston rod 50 of the displacement drive 44, reaches into the light barrier 77. Both light barriers 76, 77 are connected via lines to the control unit 62. The light barrier 77 of the switch 79 is mounted on the base plate 2 in a position in which it is lapped by the trigger blade 78 only in a certain position of the x-y table 8 in the y direction. This may for instance be the final position, in the negative y direction, of the x-y table 8. The light barrier 77 is arranged and the trigger blade 78 is dimensioned such that the trigger blade 78 runs past a switching point of the light barrier 77 upon displacement of the x-y table 8 in the negative x-y direction. Even when in a position of maximal reach into the light barrier 77, i.e. the final position in the negative x direction, the trigger blade 78 does not get into physical contact with the light barrier 77.

This design ensures that the mentioned switching point of the light barrier 77 is at a fixed distance, given by construction, from the center plane 37, because the light barrier 77 is stationary mounted on the base plate 2 and, consequently, also in stationary allocation to the center plane 37. The light barrier 77, together with the trigger blade 78, constitutes a reference switch 79.

The mode of operation is as follows:

At the beginning of a comparing and matching operation, the displacement drive 44 is unpressurized so that the movable supporting plate 11*b*, as a result of the action of the extension spring 57, takes its position near the stationary supporting plate 11*a*. The piston 51 bears against the second setscrew 59. The x-y table 8 is in its second final position counter to the direction of the x axis.

The control unit 62 causes the x-y table 8 to be displaced in the direction of the x axis by the x drive 9. The trigger blade 78 reaches into the light barrier 77, which changes the switching condition thereof i.e., it emits a signal to the control unit 72, occasioning detection of the position of the x-y table 8 which is transmitted by the rotary position transmitter 73 to the control unit 62.—If no rotary position transmitter is available, the control unit 62 detects the triggering pulses which have till then been emitted to the stepper motor and which also constitute a measure for the length till then traveled by the x-y table 8.—The position of the supporting plate 11*b*, and thus the relative distance z between the supporting plates 11*a* and 11*b*, is computed in the control unit 62 based on the mentioned value. This value, which relates to the position of the supporting plate 11*b*, is stored as information on data of spread. These data are needed, among other things, for reversing the x-y table 8 by half a length of spread d/2. Upon change of the switching condition of the light barrier 77 when the trigger blade runs past the switching point of the light barrier 77, the control unit 62 causes the x-y table 8 to be reversed counter to the x direction into the first final position mentioned at the outset.

Then the displacement drive 44 is actuated, i.e. the supporting plate 11*b* is moved into its position remote from the supporting plate 11*a*, in which it bears against the first setscrew 58. This procedure is repeated, whereby the position of the supporting plate 11*b* relative to the x-y table is detected.

This is followed by a comparison of the data, deposited in the control unit 62, on the first and second stop position and the resulting length of spread d, with the value determined for the positions. If they are not identical, the control unit 62 generates a corresponding signal which appears on the display 66 or a corresponding indication so that the setscrews 58, 59 can be re-adjusted. Renewed verification in the way described may then take place.

The measuring process specified makes use of the available information and data on the position of the x drive 9, which means that an available positioning system is used for measuring the position of the supporting plates 11*a*, 11*b* relative to each other solely by arrangement of a reference switch 79. Such a system is very simple and can be produced at a low cost.

The comparing and matching job is accompanied with determination i.e., measurement, of the distance of the two supporting plates 11*a*, 11*b* from each other by an automatic process which takes place rapidly and flawlessly. The measuring result is employed not only for the necessary correction of positioning of the x-y table 8, but also for illustration on the display 66. This is especially helpful to the operator upon modification of spread by corresponding adjustment of the setscrews 58, 59, augmenting the ease and convenience of operating the machine. Finally, the measuring result may also be used to prevent a buttonhole from being sewn when the distance of the supporting plates 11*a*, 11*b* does not comply with the data of a buttonhole program that has been called up, i.e. when the sewing machine might be damaged by a broken needle.

What is claimed is:

1. A buttonhole sewing machine, comprising a needle (7) drivable via an arm shaft (4);

an x-y table (8), which is displaceable in an x direction by an x drive (9) and in a y direction by a y drive (10), which supports a first and a second work piece clamp (13*a*, 13*b*) mounted for displacement relative to each other, and which comprises a pneumatically actuated displacement drive (44) for displacement of the work piece clamps (13*a*, 13*b*) relative to each other from an initial position of spread by a length of spread (d) into a final position of spread; and a control unit (62) for control of the drives (9, 10, 44);

wherein only the first work piece clamp (13*b*) is displaceable relative to the x-y table (8), and the second work piece clamp (13*a*) is non-displaceable relative to the x-y table (8); and wherein means are provided for defining a displacement of the first work piece clamp (13*b*) relative to the x-y table (8) by a given length of spread (d) in a first direction between a first stop position and a second stop position of the first work piece clamp (13*b*); and wherein the control unit (62) stores data for triggering the x drive (9) for a displacement of the x-y table (8) by half the given length of spread (d) in a second direction reversed to the first direction.

2. A buttonhole sewing machine according to claim 1, wherein a reference switch (79) is provided between the first work piece clamp (13*b*) and the sewing machine.

3. A buttonhole sewing machine according to claim 1, wherein the second stop position is formed by a setscrew (59) which acts on the pneumatically actuated displacement drive (44).

4. A buttonhole sewing machine according to claim 2, wherein allocated to the x drive (9) is a rotary position transmitter (73) which is connected to the control unit (62) and, via the control unit (62), linked to the reference switch (79) so that a comparing and matching operation takes place.

5. A buttonhole sewing machine according to claim 2, wherein the x drive (9) is a stepper motor which is connected to the control unit (62) and, via the control unit (62), linked to the reference switch (79) so that a comparing and matching operation takes place.

* * * * *